US005296055A

United States Patent [19]

Matsuda

[11] Patent Number: 5,296,055

[45] Date of Patent: Mar. 22, 1994

[54] TITANIUM ALUMINIDES AND PRECISION CAST ARTICLES MADE THEREFROM

[75] Inventor: Kenji Matsuda, Matsudo, Japan

[73] Assignee: Ishikawajima-Harima Heavy Industries Co., Ltd., Tokyo, Japan

[21] Appl. No.: 737,953

[22] Filed: Jul. 30, 1991

[30] Foreign Application Priority Data

Jul. 31, 1990 [JP] Japan ..... 2-201373
Aug. 17, 1990 [JP] Japan ..... 2-215846

[51] Int. Cl.[5] ..... C22C 14/00

[52] U.S. Cl. ..... 148/421; 148/669; 420/417; 420/420; 420/421

[58] Field of Search ..... 148/421, 669; 420/417–421

[56] References Cited

U.S. PATENT DOCUMENTS 4,294,615 10/1981 Blackburn et al. ..... 148/669
4,857,268 8/1989 Huang ..... 420/418
5,098,653 3/1992 Chin ..... 148/421

FOREIGN PATENT DOCUMENTS 0621884 6/1961 Canada ..... 420/418
0171862 7/1988 Japan ..... C22C 14/00
63-129642 12/1989 Japan .
2-258938 10/1990 Japan ..... C22C 14/00

OTHER PUBLICATIONS

Vujic et al Met. Trans. 19A (1988) 2445.

*Primary Examiner*—Upendra Roy
*Attorney, Agent, or Firm*—Dykema Gossett

[57] ABSTRACT

A titanium aluminide is composed of 31 to 34 mass % of Al, 1.5 to 3.0 mass % of Fe, 0.5 to 2.0 mass % of V, 0.18 to 0.35 mass % of B with remainder being Ti and inevitable impurities. The 0.5 to 2.0 mass % of V may be replaced with a 1.0 to 3.0 mass % of Mo or a 0.3 to 1.5 mass % of Cr. By precision casting this alloy, a novel titanium aluminide alloy is obtained in which numerous whisker-like Ti—B compound are uniformly dispersed. The titanium aluminide alloy does not possess a coarse lamellar structure which would cause cracking.

5 Claims, 5 Drawing Sheets

TITANIUM ALUMINIDES AND PRECISION CAST ARTICLES MADE THEREFROM

BACKGROUND OF THE INVENTION

1. Technical Field

The present invention relates to titanium aluminide, i.e., an intermetallic compound known by a chemical formula of TiAl, as an advanced material for precision casting. It relates in particular to that species of titanium aluminide whose fluidity is excellent, the precision cast articles made therefrom have a high strength in cast state and will not crack even when their thickness is small.

2. Background Art

Titanium aluminide (an intermetallic compound known by a chemical formula of TiAl referred to as "TiAl" hereinafter) is drawing attention as an advanced material for its higher specific strength at high temperature than those of the nickle-base superalloys and better oxidation resistance than those of the titanium alloys. Since TiAl has other admirable properties in addition such as low density, the strength of which becomes greater with elevating temperature and good creep resistance, there are demands to make aircraft jet engine parts such as blades and vanes out of this material in the form of thin and intricately configured precision cast articles.

On the other hand, however, TiAl is known to have low ductility at ambient temperature and have a strong dependency on the deforming speed even at high temperatures where sufficient toughness develops. To overcome these difficulties, research is being conducted from crystal structural and physical metallurgical viewpoints. For example, methods of improving the low ductility by strengthening the grain boundaries have been proposed in Japanese Patent Application Nos. 41740/1986, 255632/1989, 2874243/1989 and 298147/1989 and in U.S. Pat. No. 4,294,615.

Despite these efforts, however, the reality is that precision cast articles made of binary Ti—Al alloy remain so liable to cracking that they cannot be called an industrial product. Even with addition of a third element, e.g., V, which the above-mentioned U.S. Patent has found effective to improve a ductility, ternary Ti—Al—V alloys containing appreciable amounts of the third element, e.g., V as much as 1.5 mass %, cannot make castings, such as turbine vanes, perfectly crack-free.

Furthermore, even while the above-cited Japanese patent applications claim to produce TiAl cast articles having strengths surpassing those mentioned in the specification of U.S. Pat. No. 4,294,615, the strengths achieved at ambient temperature are in the 400 MPa level; even with addition of a strength improving element as in JPA No. 255632/1989, strengths over 500 MPa have not been realized.

For another thing, there is an observation that the poor toughness of TiAl should be considered as due, on top of the inherent brittleness of this material arising from its being an intermetallic compound, to the coarse lamellar grains that characterize its microstructure. Here, it is to be noted that the stoichiometric titanium aluminide, i.e., the one that corresponds to an Al content of 36 mass %, does not develop the lameller structure, but this material has a lower ductility than a lameller structured TiAl. With these so-called industrial TiAl alloys, which are generally of an Al content of 32 to 34 mass % because of the addition of property-modifying elements of one sort or another, on the other hand, development of the lameller structure has been considered inevitable.

As a countermeasure thereto, a proposal has been made to add B or Y so as to strengthen the lamellar grain boundaries. Even then, however, attainment of acceptably low rates of rejection is often impossible when the product is a thin and intricately configured cast article such as turbine blades because these coarse lamellar grains still induce cracking.

Now, those thin and intricately configured articles such as turbine blades and impellers are commonly manufactured by the precision casting (e.g., the lost wax or investment casting) method because other methods such as precision forging and machining are generally very difficult. Here, to ensure good fluidity (i.e., the ability of the molten matter to fill up the casting mold or cavity to its tips) for the material is a must to attain a high yield of good castings or low enough rejection rates. In the case of TiAl, however, deterioration of the rejection rate is simply inevitable if an additive such as Mo, V and Nb has been added in a large quantity even for the sake of improving the toughness, because such an addition inevitably raises the melting point, enlarges the solidification temperature range and decreases the melting latent heat, all contributing to aggrevate the fluidity. In particular, the melting temperature having been elevated means that Ti is activated that much and its reaction with the casting mold is promoted that much, thereby making sound casting that much more difficult.

SUMMARY OF THE INVENTION

An object of the present invention is to provide a TiAl that will enable production of crack-free precision cast articles.

Another object of the present invention is to provide such a TiAl that will prevent the occurrence of cracks in thin and intricately configured precision cast articles by suppressing the formation of the coarse lamellar structure ordinarily characteristic of TiAl as well as develop the tensile strengths at ambient temperature of over 500 MPa.

For the purposes set forth above, V is added to a mass % that satisfies the formula (I) given below to a binary Ti—Al alloy that is defined by an Al-to-Ti mass % content ratio (denoted by "Al/Ti ratio" hereinafter) of 0.49 to 0.54 and containing inevitable impurities. Namely, $$V=(14.3\times Al/Ti-6.69)\pm 0.2 \quad \text{(I)}$$

where V is quantity of V in mass % and Al/Ti (the Al-to-Ti ratio as defined above) pertains to the Al and Ti contents in mass % in the Ti—Al binary alloy system.

Preferably, moreover, the casting mold is preheated to a temperature in an approximate range of 400° to 600° C.

The present invention is a result of research on the effects of the Al content in the binary TiAl on the hardness, those of the Al/Ti ratio on the hardness of TiAl containing 1.5 mass % V, those of the Al/Ti ratio on the correlation between V content and hardness, etc.

Namely, as shown in FIG. 3, the hardness (here given in terms of Hv, the Vickers hardness number, for a load of 5 kgf) of binary Ti—Al alloy changes greatly with the changes in the Al content, even though the melting point and the solidification range change little. This fact has a great deal to do with the process of precision casting when it comes to taking the article out by breaking the mold immediately on completion of the casting and cooling, even though it does not reflect on the properties determined for annealed or isothermally forged ingots and billets.

Next, the description deals with the effect of addition of V by 1.5 mass % referring to FIG. 4 where the dotted line is the curve of FIG. 3 transcribed thereinto: the result is to merely translate the trend line to higher Al/Ti side. In fact, the use of ternary Ti—Al-1.5 V alloy in precision casting, e.g., a turbine vane, does not perfectly forestall the cracking as noted eariler on, yet a benefit is seen in the reduced frequency of occurrence of crackings.

On the other hand, it was discovered that this benefit of V addition can be had without incurring undue hardness increase, in fact, often reducing the hardness actually, and also that this admirable result can be achieved by controlling the V content with regard to the Al/Ti ratio as defined by the formula (I) introduced above. It was also found that the crackings of cast articles can be prevented if the hardness is held to Hv 300 and less.

Here, the Al content is specified to be in an approximate range of 33.0 to 35.0 mass %, i.e., a range of 0.49 to 0.54 in terms of the Al/Ti ratio, pertaining to the binary Ti—Al system. This is based on my own research results that the beneficial effect of V addition can be realized most readily in its range, that when the Al content is smaller than 33%, the alloy is liable to produce too much $Ti_3Al$ which incurs cracking, and that when the Al content is greater than 35%, the cast structure becomes coarse, leading into crackings again. One thing to be remembered here is that with the binary Ti—Al alloy, the hardness becomes less than Hv=300 for Al contents of 34% and above, with or without addition of V, but crackings do not cease to occur.

As for the addition of V, I specify it as in the formula (I) introduced earlier on. This formula follows the hardness minima shown in FIG. 1 with an allowance band of ±0.2 mass % and ensures no occurrence of crackings.

An example is shown in FIG. 2 with photomicrographs (at a magnification of 200X) of two ternary Ti—Al—V alloys and a binary Ti—Al alloy. In FIG. 2(*a*), the alloy is of a composition 65.7Ti-33.8Al-0.5 V, i.e., an alloy of this invention, and the microstructure is that of refined grains breaking up the coarse lamellar grains, the hardness being 250 Hv; in FIG. 2(*b*), the alloy is 65.0Ti—35.0Al and the microstructure is typical course lamellar structure; and in FIG. 2(*c*), the alloy is again ternary as in FIG. 2(*a*), but as the composition is 66.0Ti—32.5Al—1.5 V, the structure is coarse lamellar type as in FIG. 2(*b*), the hardness being 376 Hv.

From these observations, I have concluded that the major cause of crackings should be ascribed to the course lamellar structure so much so that simple addition of V, even by as much as 1.5 mass %, does not entail successful prevention of cracking for thin castings with a thickness less than 1 mm, because then there are only several crystals available in the thickness direction and therefore that the refinement of grains and breaking up of the lamellar structure therewith is the way to success.

There are cases, on the other hand, wherein the Al content falls within the specification range, the hardness would be less than 300 Hv, and occurrence of crackings not to be feared by the reason of the configuration of the article or such. Then addition of V in a slight excess of the range defined by the formula (I) is allowed.

Preheating of the casting mold to 400° to 600° C. or thereabout is an effective means to reduce the rejection rate further, although this practice is unnecessary when the thickness is 1 mm and over or when the configuration is simple.

As for the fluidity, a property which is of particular importance in the precision casting as noted earlier on, Al contents of less than 50 mass % are disadvantageous even if the Al/Ti ratio is kept as specified, because then the solidification temperature range can be as large as 50° to 55° C. as shown in FIG. 5. In fact, even with TiAl of this invention composition, sound castings of a thickness less than about 0.8 mm are hard to manufacture. Here, the preheating of the casting mold to 400° to 600° C. is so effective in improving the fluidity that articles as thin as 0.3 mm can be cast readily by the conventional lost wax method of precision casting.

For attainment of the second purpose, i.e., prevention of formation of the lamellar structure without unduly raising the melting point or enlarging the solidification temperature range, I specify the following composition range:

Al: 31–34%; Fe: 1.5–3.0%; V: 0.5–2.0%; B: 0.18–0.35%; the remainder being Ti with unavoidable impurities.

Here, either Mo of 1.0–3.0% or Cr of 0.3–1.5% may be taken in place of the 0.5 to 2.0% V.

An example of precision cast microstructure obtained with this type TiAl is shown in FIG. 6, where numerous whisker-like Ti—B compound are uniformly dispersed. I have found that it is these compounds that not only have erased the lamellar structure (shown in FIG. 10) that is the major cause of cracking, but being present as cast, they contribute to raising the strength of the casting. In addition, I have found that their size can be controlled as desired by controlling the cooling rate of the cast.

For these reasons, I prefer to call this new species of titanium aluminide the Ti—Al based, Ti—B compounds dispersed composite titanium aluminide, but breach of my specification will degrade the dispersion toughened TiAl as follows:

When Al content is less than 31% and particularly when the Al/Ti ratio is less than 0.49 at the same time, the Ti—B precipitates become coarse, allowing the lamellar structure to appear as shown in FIG. 7, thereby degrading the toughness appreciably. Or, when Al is more than 34% and particularly when the Al/Ti ratio is over 0.55, the Ti—B precipitates will coagulate each other as shown in FIG. 8, degrading the toughness again.

When B is less than 0.18%, on the other hand, the formation (or crystallization) of Ti—B becomes insufficient, and when it is over 0.35%, the hardness of the TiAl will become excessive, both degrading the toughness.

Here, Fe works importantly: when it is less than 1.5%, the fluidity is degraded and the Ti—B formation (or compounds) are coarsened; when it is over 3.0%, the hardness becomes excessively large, the specific gravity undesirably large, thereby degrading the featured lightness of this material and the Ti—B compounds coarsened as shown in FIGS. 8 and 9, degrading the toughness.

Lastly, V, as well as Mo and Cr as its substitute, works to refine the Ti—B formation (or compounds), and the specified limits are to ensure this effect. Especially, when V is added so as to conform the formula (I), the finest and the most desirable microstructures are realized.

DESCRIPTION OF THE PREFERRED EMBODIMENTS

Now, preferred embodiments of the present invention will be described with reference to the accompanying drawings.

For demonstration of the first embodiment, I have made a set of two Ti—Al—V alloys to the compositions shown in Table 1 with a plasma skull melting furnace and have produced or cast two turbine vanes A and B by the shell mold lost wax method of precision casting. The turbine vanes A and B were found to have come up, as cast, with the mechanical properties shown in Table 1.

TABLE 1

| Vane | Composition (Mass %) | Strengths* (MPa) T.S.*2 | Y.S.*3 | Elongation* (%)* | Cracking |
|---|---|---|---|---|---|
| A | 65.6 Ti-33.7 Al-0.7 V | 445 | 415 | 0.47 | No |
| B | 67.0 Ti-31.5 Al-1.5 V | 501 | — | 0.15 | Yes |

*at room temperature;
*2tensile strength;
*30.2% offset or "proof" yield strength In Table 1, it will be observed that the vane A whose composition satisfies my specification has developed an admirable set of properties whereas the vane B whose composition lies outside of my specification had failed, developing many crackings, in unstable fracture before the 0.2% offset strain was attained. This also accounts for the difference in the elongation which was over three times as good for the vane A than for the vane B.

The results presented Table 1 prove that I am able to produce thin and intricately configured articles such as wheels and turbine vanes by practicing the precision casting ordinarily.

In addition, I can manufacture yet thinner articles such as 0.3 mm thick turbine vanes for a good yield of castings by the same method except preheating the casting mold to 400° to 600° C.

Namely, this demonstration proves that the above described first preferred embodiment method is capable of:

(1) producing crack-free articles by precision casting; and (2) producing precision cast articles of very small thickness at a good yield.

Figure 1:
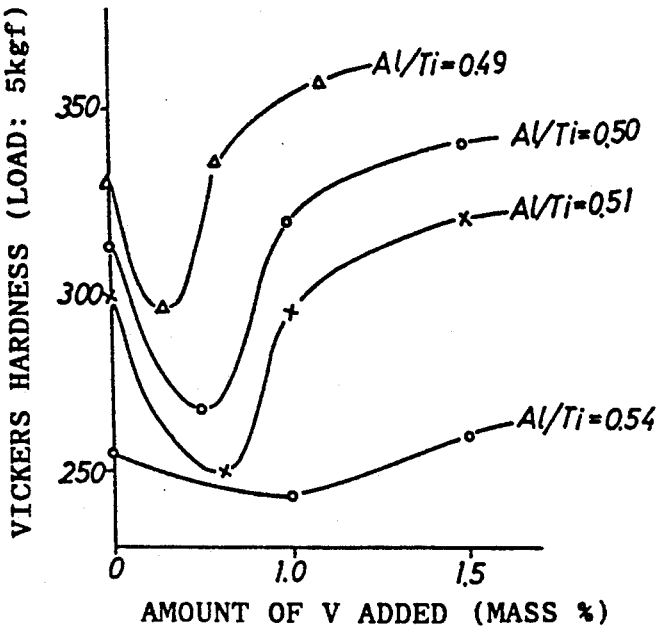
FIG. 1 shows effects of V addition on the hardness of titanium aluminide (Ti/Al) of various Al/Ti mass % ratios.
Figure 5:
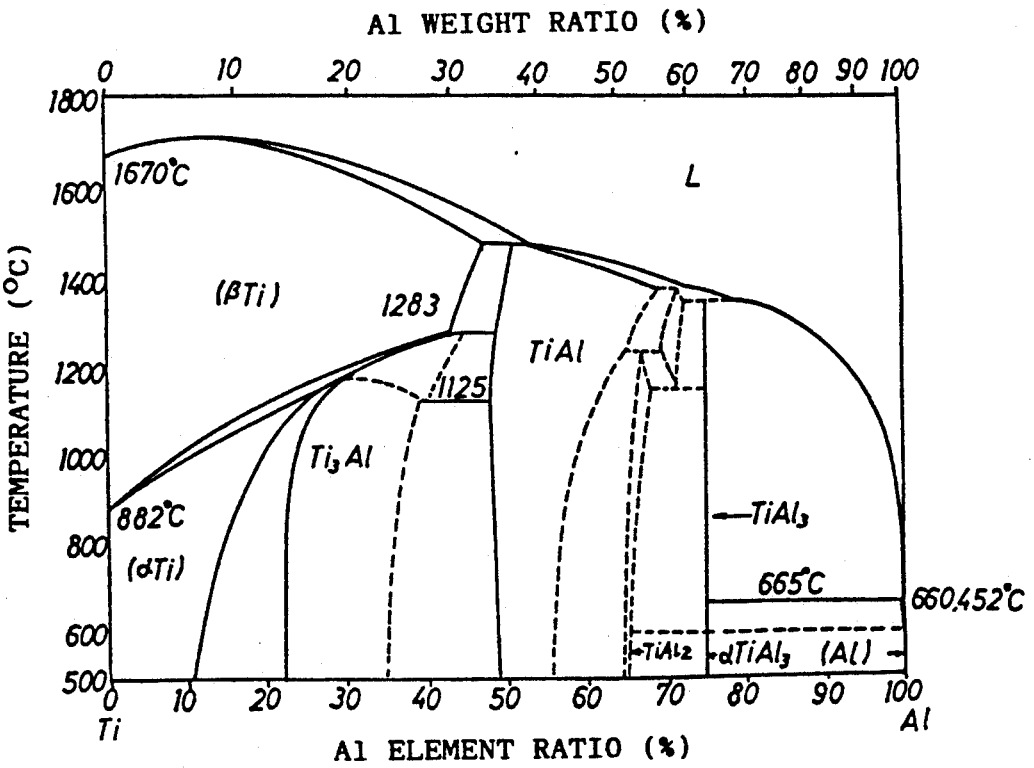
FIG. 5 is an equilibrium phase diagram of binary Ti—Al system.
Figure 2A:
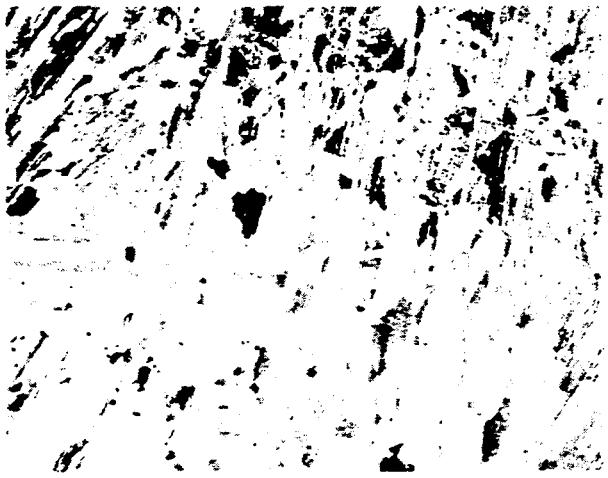
FIG. 2 is a set of photomicrographs showing microstructures of three different kinds of TiAl alloys.
Figure 2B:
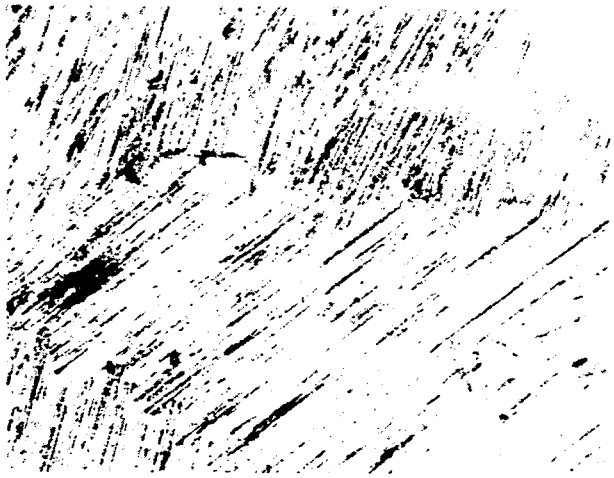
Figure 2C:
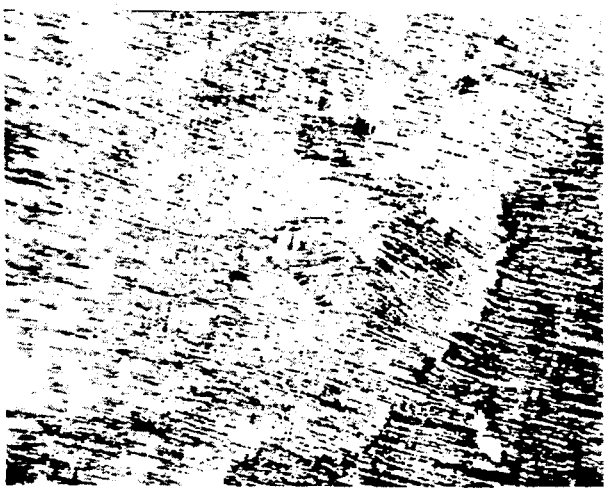
Figure 3:
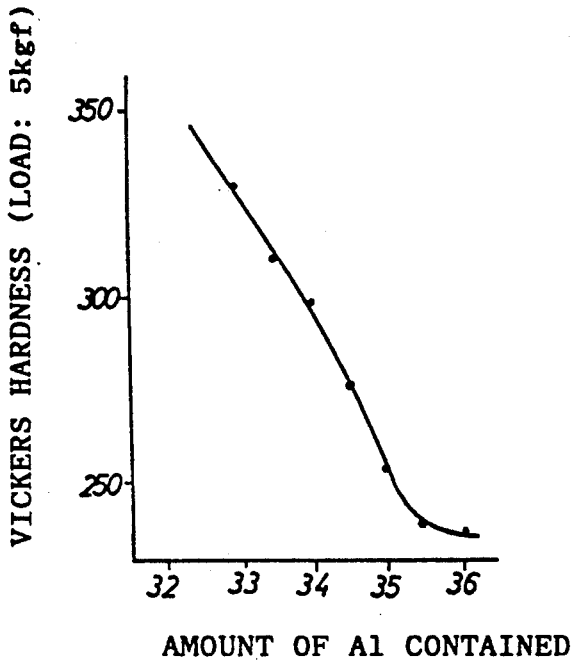
FIG. 3 is a diagram showing the effects of the Al content on the hardness of binary Ti—Al alloys.
Figure 4:
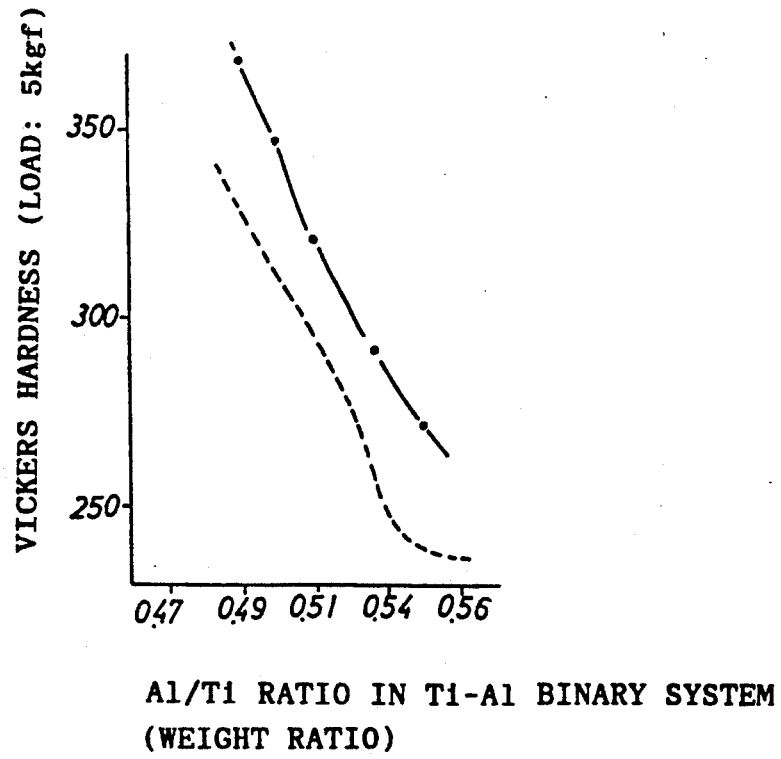
FIG. 4 is a diagram showing the effects of addition of 1.5 mass %V as a function of the Al/Ti ratio.
Figure 6:
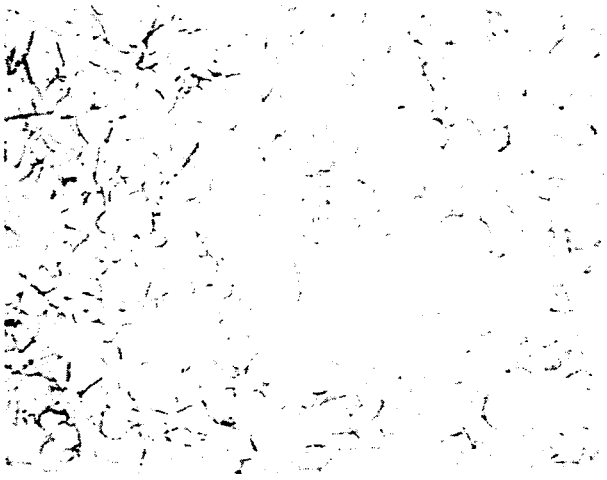
FIG. 6 is a photomicrograph showing the microstructure of the present invention TiAl.
Figure 10:
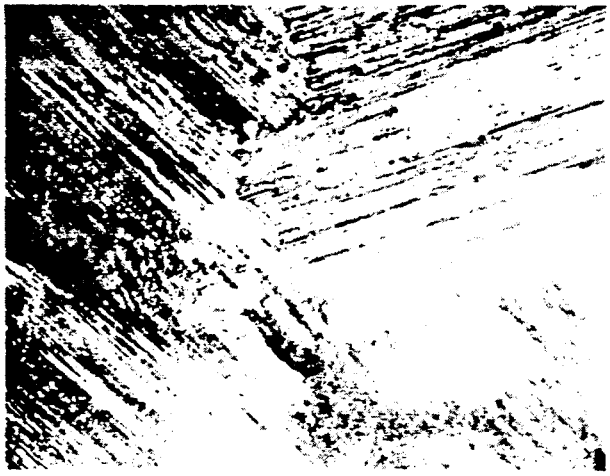
FIG. 10 is a photomicrograph showing the microstructure of a conventional titanium aluminide for precision casting.
Figure 7:
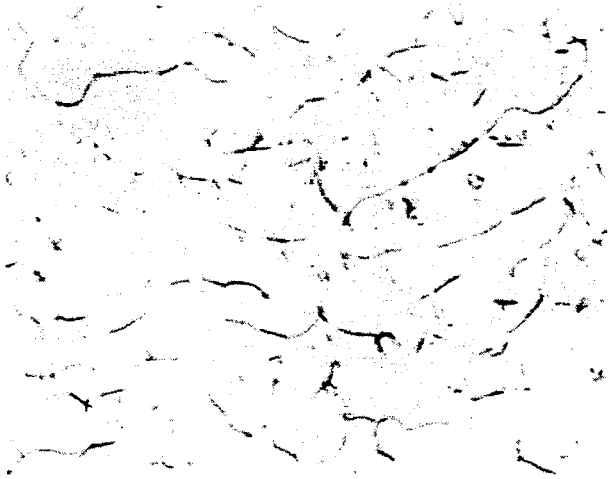
FIGS. 7 to 9 are photomicrographs showing consequences of failing to observe the composition specifications of the present invention, respectively.
Figure 8:
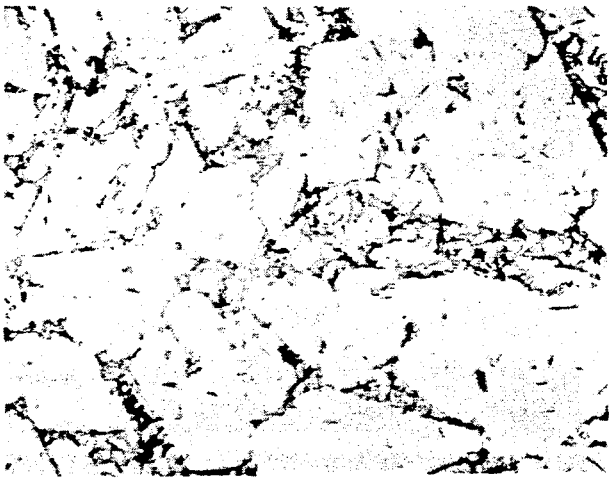
Figure 9:
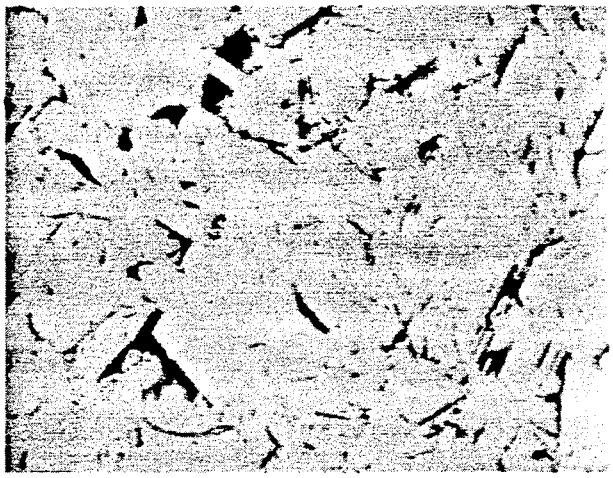

Now, turning to the second embodiment of my invention, I compare the microstructure of my TiAl shown in FIG. 6 with that of a typical conventional TiAl shown in FIG. 10. Namely, in FIG. 10, which as taken, at a magnification of 400X, of a conventional binary TiAl with an Al content in the 32 to 36 mass % range, the so-called coarse lamellar structure is seen to have developed as usual. This lameller structure persists even in alloy added with 0.8 to 2.0 mass % of a third element, e.g., Mo, V, Nb or Cr, the practice which is said to be effective to improve the toughness although the interlamellar distance is said to decrease with decreasing Al/Ti ratio and the grain boundaries be strengthened on addition of B, Y or the like element. In any case, the coarse lameller structure of this kind makes the alloy liable to crack, so much so that manufacture of thin (less than several mm in thickness) and intricately configured precision cast articles such as shrouded turbine vanes at an acceptably low rejection rate has been difficult if not at all impossible.

Against this, the microstructure shown in FIG. 6, which was taken of a TiAl of the present invention, i.e., one with a composition 32% Al, 2.0% Fe, 1.0% V, 0.25% B and the rest Ti with unavoidable or inevitable impurities, ensures successful manufacture of thin and intricately configured articles by the conventional practice of precision casting, all as cast, i.e., without calling for additional processing. Here, the apparent absence of the lamellar structure, having either been eliminated altogether or been so refined as to become undiscernible under an optical microscope, and instead the conspicuous presence of the whisker-like Ti—B compound in uniformly dispersed state (or condition) should be noted at the same time.

The room temperature tensile tests conducted with test pieces machined out of a sample, which was co-cast in the form of round rod of 12 mm (diameter)×60 mm (length) with the precision cast product, revealed the 0.2% proof strength to be 465 MPa, the tensile strength, 517 MPa and the elongation, 0.58%. Namely, the desired level of the strength has been attained coupled with relatively high ductility.

Now, the whisker-like Ti—B compounds can be made finer, thereby contributing even more to raising the strength, the faster the cooling rate of casting. This can be achieved by lowering the temperature of the casting mold: for example, in order to have the Ti—B compound to form (or crystallize) in a turbine blade of 25 mm (width)×70 mm (length)×2 mm (thickness) or thereabout as whickers of about 20 micrometers in diameter as shown in FIG. 6 while manufacturing it by the lost wax method of precision casting, I choose a mold temperature of less than 400° C. In this case, the specified composition ensures the melting point to be low enough and the fluidity high enough to carry out the casting successfully despite the low mold temperature. Also, the specified composition prevents the active Ti from reacting with the mold unduly, so that sound and dimensionally highly accurate castings are produced.

If such refinement of the Ti—B compounds is not particularly wanted, on the other hand, the mold temperature may be set in the approximate a range of 400° to 600° C., thereby ensuring better fluidity for the molten TiAl.

For these observations, I have elected to call this type of TiAl the Ti—Al based, Ti—B compound strengthened composite titanium aluminide as mentioned earlier on in the recognition that the Ti—B formation being in-situ, this is a new species, entirely different from the conventional ones, where the dispersion hardening element, e.g., SiC whiskers and alumina particles, is mechanically mixed in.

I have concluded therefore that the second embodiment of my invention is capable of developing the following admirable effects:

(1) producing a microstructure, having the characteristic coarse lameller structure seemingly disappeared and instead having numerous whisker-like Ti—B compound crystallized out uniformly dispersed so that cracking is effectively prevented even in thin articles and tensile strengths at ambient temperature of over 500 MPa are ensured as cast;

(2) controlling the size of the Ti—B compounds as desired by controlling the cooling rate of the casting;

(3) producing thin and intricately configured articles by conventional precision casting method at a low enough rejection rate, through lowering the melting point, preventing the active Ti from reacting with the casting mold unduly, and ensuring sufficiently high strength and toughness; and (4) producing clean articles owing to the fact that, unlike the conventional composites that are made by mixing up SiC whiskers or alumina powder, this is an in-situ formed composite of T—B and titanium aluminide.

We claim:

1. A titanium aluminide comprising:
31 to 34 weight % of Al;
1.5 to 3.0 weight % of Fe;
0.18 to 0.35 weight % of B; and
a predetermined amount of an element for refining Ti—B formation, with remainder being Ti and impurities.

2. The titanium aluminide of claim 1, wherein the Ti—B formation refining element includes 0.5 to 2.0 weight % of V.

3. A titanium aluminide comprising:
31 to 34 weight % of Al;
1.5 to 3.0 weight % of Fe;
0.5 to 2.0 weight % of V; and
0.18 to 0.35 weight % of B, with remainder being Ti and inevitable impurities.

4. A titanium aluminide comprising:
31 to 34 weight % of Al;
1.5 to 3.0 weight % of Fe;
1.0 to 3.0 weight % of Mo; and
0.18 to 0.35 weight % of B, with remainder being Ti and inevitable impurities.

5. A titanium aluminide comprising:
31 to 34 weight % of Al;
1.5 to 3.0 weight % of Fe;
0.3 to 1.5 weight % of Cr; and
0.18 to 0.35 weight % of B, with remainder being Ti and inevitable impurities.

* * * * *